United States Patent [19]

Ruttenberg

[11] Patent Number: 4,955,539

[45] Date of Patent: Sep. 11, 1990

[54] METHOD AND APPARATUS FOR CONVERTING PRESSURIZED LOW CONTINUOUS FLOW TO HIGH FLOW IN PULSES

[76] Inventor: Gideon Ruttenberg, 81465 Date Palm Dr., Indio, Calif. 92201

[21] Appl. No.: 345,661

[22] Filed: May 1, 1989

[51] Int. Cl.[5] ..... B05B 1/08

[52] U.S. Cl. ..... 239/1; 239/99; 239/276; 239/428.5; 137/624.14; 137/853; 137/895

[58] Field of Search ..... 239/99, 101, 276, 428.5, 239/1; 137/624.14, 853, 860, 843, 895, 888

[56] References Cited

U.S. PATENT DOCUMENTS

| | | | |
|---|---|---|---|
| 2,715,980 | 8/1955 | Frick | 137/853 |
| 2,988,288 | 6/1961 | Nielsen | 239/590.5 |
| 3,865,133 | 2/1975 | Alford | 137/853 |
| 3,902,664 | 9/1975 | Deines | 239/99 |
| 3,920,185 | 11/1975 | Kwok | 239/99 |
| 4,256,262 | 3/1981 | Rosenberg et al. | 239/276 |
| 4,702,280 | 10/1987 | Zakai et al. | 239/99 |

FOREIGN PATENT DOCUMENTS

| | | | |
|---|---|---|---|
| 0191716 | 8/1986 | European Pat. Off. | 239/99 |

*Primary Examiner*—Andres Kashnikow
*Assistant Examiner*—Karen B. Merritt
*Attorney, Agent, or Firm*—I. Louis Wolk

[57] ABSTRACT

This invention relates to a device and method for converting low continuous liquid flow to a high intermittent and pulsating flow. They are especially adapted for operating sprinklers, shower heads and venturi pumps at low flow. Applicant has accomplished these objectives by introducing liquid at a controlled low rate of flow such as by the use of pressure compensating drippers in a liquid supply line, thence into a chamber which is somewhat expansible in volume and increasing pressure therein while restricting the outflow of the liquid until pressure created by introduction of such liquid is sufficient to eject the liquid intermittently at a higher flow and over a greater area. This is achieved by utilizing a pressure responsive check valve in the liquid exit and more particularly by utilizing a check valve designed for quick response to create a water hammer effect. At the same time the check valve is provided with openings downstream of the exit to create a venturi effect to admix air or another liquid with the effluent stream. The sprinkler units may be mounted upon chambers in the form of spikes for insertion into the ground, which spikes may also be mounted in a spaced manner upon the pipe or conduit supplying liquid thereto. The chamber may also be in the form of a flexible section of conduit upon which the check valve and spray unit are mounted supported upon the ground by means of a vertical rod or the like.

29 Claims, 2 Drawing Sheets

METHOD AND APPARATUS FOR CONVERTING PRESSURIZED LOW CONTINUOUS FLOW TO HIGH FLOW IN PULSES

BACKGROUND OF THE INVENTION

Most trees in the world require very small amounts of water per day. If water to the tree would be supplied over a 24 hour period every day, a very small flow would be required for each tree to supply its needs.

In order to develop a good root system and to allow the ground to store water for the tree, water to the tree should be supplied in such a way that a large wetted area would be created next to the tree.

Commonly used systems cannot wet a large area next to the tree by using such small flow as described. A much higher flow per tree is required with those systems in order to create a large wetted area. This is what makes all such systems complicated and expensive. It requires larger size pipes and numerous valves to control the system.

By using the method and apparatus described in this invention, a spray means can spray water and wet a large area next to the tree by using a very small flow. An irrigation system using such a device will be able to supply to each tree a very small flow which is much smaller than required by conventional drip or mini-sprinkler systems, and create a large wetted area next to the trees.

Some of the prior art systems utilize a device which converts low pressurized flow to high, non-pressurized flow, consisting of a non-pressure container and a syphon tube. Water is supplied to the container at a low flow. When water accumulating in the container reaches a certain level, it flows out by gravity, through the syphon, at a very high pulsating flow to wet a large area next to each tree.

Different types of injection pumps are used in irrigation systems to inject fertilizer into the system. A venturi type injection pump is commonly used in irrigation systems. In order to create a large enough suction power with a venturi pump, a relatively high flow of water has to flow through the venturi pump.

Shower heads are designed in such a way that water is being ejected at relatively high velocity over a large designated area. In order to do it, common shower heads use a very high flow of approximately 120–180 gallons of water per hour. As a result, the water supply system should be designed to supply this high flow. Because of the high flow, the amount of water used for every shower is very high.

Instant heating elements are being used to create instant warm water for showers and for sinks. Because of the high flow of water passing through the shower head, relatively high power heating elements are required.

SUMMARY OF THE INVENTION

This invention relates to a device and method for converting pressurized low continuous liquid flow to pressurized high intermittent and pulsating flow.

The pressurized hydraulic transformer (P.H.T.) which is described herein is useful in any application in which low continuous liquid flow can be converted to higher rates of flow in pulses in a continuous repetitive manner.

Although liquid flows out of the P.H.T. at a high rate in a small fraction of time in each pulsating cycle, some properties that are related to high rate of liquid flow can be achieved by using low flow.

It further relates to a method and apparatus for distributing liquid to a large designated area with a low flow, using a spray device that in regular operating conditions will need a much higher flow.

It is also related to a method and apparatus for pumping liquid in a similar manner to a venturi pump, yet with a much lower flow and with small friction losses.

In one preferred application, this invention relates to a device, such as a mini sprinkler, that under regular operating conditions will spray liquid to a certain designated area by using a flow Q1.

By using the P.H.T., the same spray device will spray liquid to the same or larger designated area, using a much smaller flow Q2. When liquid is being ejected from such a device, its instant flow is Q1 and it is being ejected during a short time t of a cycle time T, in such a way that:

Its actual flow is $Q2=Q1\times t/T$. For example, if a regular mini sprinkler having a flow of $Q1=8$ GPH is forced to pulsate so that it will eject liquid for 1 second (t) every 4 seconds (T), its actual flow Q2 will be 2 GPH. Yet, since its instant flow during the spray portion of the cycle is at the rate of $Q1=8$ GPH, it will spray water to the same distance as a mini sprinkler having a flow Q1, operating at the same pressure, but actually using only 2 GPH.

As described herein and shown in the drawings, such a device includes the following main items:

A. A pressure compensated dripper, or other means that will be described, which is fed from a liquid supply tube and discharging low continuously controlled flow to a pressure container.

B. A pressure container, such that pressurized liquid flowing into it will cause it some deformation that will allow its volume to be increased due to pressure increase within the container. Different forms of such containers will be described.

C. A pre-set check valve designed to open itself at a critical pressure P1 and close itself at a lower pressure P2. Different types of such pre-set check valves can be used. One such check valve that has an elastic sleeve which responds to pressure differential, will be described in detail. Such check valve has a quick response which is used to create a "Water Hammer" that increases the pressure and the velocity of the ejected liquid. Such a check valve also has perforation in its casing, downstream from its sealing point by which, due to a venturi effect, fluids can be forced to flow from the surroundings of the check valve and mix with liquid that flows out from container and eject in a similar way to the operation of a venturi pump.

D. A small size tube, or other means which will be described that create a resistance to the flow or back pressure on the check valve, which forces the check valve, when it opens due to pressure, to become widely open and allow for relatively high flow of liquid to flow from the container through the check valve and the hydraulic resistance.

For example, liquid may flow from a liquid supply tube through a compensated dripper (A) to a pressure container (B), at a controlled low continuous flow Q2. As liquid accumulates in the container (B), the volume and pressure in the container (B) is increased to the critical pressure P1, which forces a pre-set check valve (C) that is connected to containers outlet, to open. Liquid then flows from the pressure container (B) through the pre-set check valve (C) and a resistor (D), which forces pre-set check valve (C) to become widely open at a high flow Q1. While liquid is being ejected from the container (B) at high flow Q1, it's being discharged to the container (B), through dripper (A), at a low flow Q2. As a result, the volume of liquid in the container (B) will be decreased by DV=(Q1−Q2)t, the pressure in the container (B) will be decreased below P2 and the pre-set check valve (C) will close the outlet from the container (B).

Liquid will continue to flow through dripper (A) to the container (B) increasing volume and pressure within the container (B) and a new pulsating cycle will begin.

The quick action of the pre-set check valve which causes the outlet from the container to be quickly shut off, creates a "Water Hammer" which causes pressure to drastically increase. "Water Hammer" is the well known term used to express the resulting shock caused by the sudden decrease in the motion or velocity of fluid. Thus, the increase in pressure caused by the sudden closing of an outlet, i.e., a valve or the like, will cause a sudden increase in pressure. This effect is utilized in the system described herein.

As a result, when a sprinkler is connected to such a device, the sprinkler throws water to a large diameter then the same sprinkler operating at same pressure without the P.H.T.

When liquid flows through a pipe made from non elastic material and the liquid is water at 60° F., as a result of "Water Hammer", the pressure increase P (in PSI) will be:

P=65 V, where V is the velocity of the liquid in F/sec.

When using elastic material, the pressure increase due to the "Water Hammer" effect will be:

$$P = 65V\frac{1}{1+K}$$

$$K = \frac{\text{modulus of water } (E.W.)}{\text{modulus of pipe material } (E.M.)} \times \frac{\text{diameter of pipe} - D}{\text{wall thickness of pipe} - W}$$

OR $$K = \frac{E.W.}{E.M.} \times \frac{D}{W}$$

When the device is made of very elastic material, which means small E.M., K will be large and pressure increase will be small. In order to achieve the "Water Hammer", the device should be made from rigid material or one with low elasticity.

By way of example, in the case where the outlet conduit (D) comprises a rigid tube having a length of 6" and an I.D. of 0.080", where the flow to the container is at the rate of 2 G.P.H., the check valve will open and close rapidly creating "Water Hammer" effect and produce frequent rapid pulses at the rate of about 10 pulses per second with the result that using a finger jet type of spray nozzle with orifice of 0.040" which would normally spray water to a diameter of 6', by using the device it will spray water to diameter of 25'.

The volume of liquid ejected at each pulse, DV, depends on a few factors. These are the size of container (B), its elasticity, critical pressure P1 and P2 of the pre-set check valve, etc.

One way of increasing the amount of liquid ejected at each pulse is by using a container with a certain geometric shape that allows its volume to be increased without changing its circumference. Such a container can be produced from a rigid material that has a very small flexibility and would generally be one which is a rectangular transverse cross section.

Such a container, for example, can have a square cross section of 1"×1", horizontal circumference of 4" and a cross section area of 1 square inch and a predetermined length. If the pressure in such a container will force its cross section to become circular, its circumference will still be 4" and its cross section will increase to 1.27 square inches, which means an increase of 27% in volume can be achieved with such a container without changing its circumference.

Such a container, made of a rigid material and having such a geometric shape, will allow its volume to be increased due to pressure changes, and still maintain the possibility of creating "Water Hammer". For certain applications, a container formed of a desired degree of resiliency may be used.

Another possibility of increasing the ejected amount of liquid in each pulse is by using trapped air in the container.

Pressure changes in the container will cause trapped air to contract and expand, thus increasing the ejected amount of liquid. The trapped air can be formed in the container in different ways. Since air might be dissolved in the liquid, and thus escape from the container, the air can be trapped in a small secondary container, for example, a small, hollow, flexible ball installed in container (B). Pressure increase in container (B) will cause the ball to contract and allow for more liquid to be accumulated in container (B) before it will be ejected.

In order to force pre-set check valve (C) to become widely open, a resistance to the flow should be created downstream from the pre-set check valve. The magnitude of such resistance depends on a few factors and mainly on the properties of the pre-set check valve (C) and the inlet flow Q2 to the container (B).

The resistor (D) should be such that it will create enough resistance to the inlet flow Q2 to force pre-set check valve (C) to widely open, yet it should be as small as possible to create minimum resistance to the high ejected flow Q1 from container (B).

The resistance can be an hydraulic resistance created by friction loss due to a liquid flowing through a small size diameter tube, or a small orifice. It can be created due to elevation difference between a spray nozzle and the pre-set check valve (C). It can be mechanical resistance created by an obstacle, for example, a floating ball installed in the path of flow between the outlet of the pre-set check valve (C) and the spray nozzle, or it can be a combination of such factors.

When liquid flows through a dripper (A) to container (B) at low flow Q2, and is then ejected from container (B) through pre-set check valve (C), which has an elastic sleeve and perforations in its casing downstream from its sealing point, at a high flow Q1, and through a hydraulic resistor (D) having a small size inside diameter, the liquid flows through the tube (D) at a very high velocity. This can be used to create a vacuum, which will force a fluid surrounding the pre-set check valve (C) to flow through its perforation by suction and mix with the liquid that flows through dripper (A) to container (B) and pre-set check valve (C) and eject as a mixture through tube (D).

As such, the P.H.T. operates in a similar way to a venturi injector with the exception that it is operated by a flow Q2, that is much smaller than the flow required by a regular venturi pump.

When liquid flows to the container (B) at a controlled rate, for example, when using a pressure compensated dripper (A), a controlled rate of fluid will enter the perforations of check valve (C) and a controlled amount of mixture will be ejected through tube (D).

When the perforations in the pre-set check valve are surrounded by air, a mixture of liquid flowing through dripper (A) and air flowing through the perforations in pre-set check valve (C) will be ejected through tube (D).

When perforations in pre-set check valve (C) are surrounded by a second liquid namely liquid fertilizer, a mixture of liquids consisting of one liquid flowing through dripper (A) and a second liquid flowing through perforations in the casing of pre-set check valve (C) will be mixed and ejected through tube (D).

When such a device is installed in a container in which a second liquid is being stored, as long as the level of the second liquid within the container is higher than the level of the perforations in the pre-set check valve (C), a mixture of the two liquids will be ejected through tube (D).

When the level of the second liquid in the container is at or below the level of the perforations in the pre-set check valve (C), a mixture of liquid from dripper (A) and air from the container will be ejected through tube (D).

By adjusting the level of the pre-set check valve (C) in the container of the second liquid, the total amount of second liquid that will be ejected in each operation can be controlled.

When the pressure in the liquid supply system is kept below the critical pressure P1 of the pre-set check valve (C), the outlet from container (B) will stay closed, and liquid will not be able to drain from pressure container (B), which means, by reducing the pressure in the liquid supply system below the critical pressure P1 of the pre-set check valve (C) we can prevent the system from draining at the end of each operation.

The pre-set check valve (C) can be designed to have a different critical pressure P1. For example, one group of pre-set check valves can be designed to have a critical pressure of P1=20 PSI and a second group can have a pre-set check valve with critical pressure P1=40 PSI. If the two groups are connected to the same liquid supply system, they can be operated as follows:

When pressure in the liquid supply system is lower than 20 PSI, no liquid flows out from the system.

When pressure in the liquid supply system is higher than 20 PSI and lower than 40 PSI, liquid will flow out from the system only through group one.

When pressure in the system is higher than 40 PSI, liquid will flow out through the two groups Each, a few, or all features of the P.H.T. can be used in different applications, some of which arc described below.

As one example I have designated as a Pulsating Compensated Non leaky Minisprinkler (P.C.N.M.).

See FIG. 1 of drawings as described below.

Such a device includes:

A. A pressure compensated dripper.
B. A pressure container having a form of a spike.
C. A pre-set check valve having perforation in its casing and a quick respond.
D. A small size inside diameter rigid tube.
E. A spraying device.

This P.C.N.M. unit has the following features:

It can be operated at a very low flow, namely Q2–2 G.P.H.

It will wet a very large area, namely, a wetted area having a diameter of 20'.

Its flow is compensated. It will spray the same flow regardless of the pressure in the irrigation tube.

Its spray nozzle will be relatively large, namely 0.040", which will eliminate its plugging.

It will eject water and air and this, too, can eliminate plugging of the spray nozzle.

Due to "Water Hammer" water will be ejected at a very high velocity.

When pressure in the irrigation tube will be decreased below the critical pressure P1, namely, below 20 PSI, by shutting off the main valve, the water in the irrigation pipes won't drain, and the system will stay full.

Two groups of such P.C.N.M. units can be connected to the same irrigation system. One group having a low P1, namely, P1=20 PSI, may be used only for irrigation, and a second group, having P1=40 PSI may be used only for emergency, namely, frost protection. The second group of P.C.N.M. units will be operated only in emergency by increasing the pressure in the system.

A second application of the P.H.T. is as a low flow shower head.

The principles of designing such low flow shower heads and its features are similar to those of the P.C.N.M. The physical shape and size of the device will be designed according to the special application and will include the following items:

A. A compensated dripper having a flow of approximately 20 G.P.H.
B. A pressure container which can be designed to be hung from the wall or be held by hand.
C. A pre-set check valve.
D. A rigid or semi rigid tube.
E. A spray nozzle.

Such a shower head can be used with a heating element to produce an instant warm water shower head. In this case, a heating element and a flow switch can be added and by turning on the faucet, low flow of water will flow through a heating element of approximately 1,500 W. which will be turned on by the flow switch.

A similar device can be produced for supplying instant warm water to sinks.

A third group of applications of the P.H.T. are venturi injection pumps, operating at a low flow.

The principles of designing and operating such an injection pump are similar to those of the P.C.N.M. described above. When, for instance, pre-set check valve (C) is dipped in a container having liquid fertilizer and dripper (A) is connected to a water supply system, the ejected mixture can be designed to flow through tube (D) and a spray device, to spray liquid fertilizers directly on plants or end of tube (D) can be connected to a system to which we want to inject the liquid fertilizer.

The frequency or number of pulsations per unit of time depends upon a number of factors, such as volume of the container, the elasticity of the container, the range of time between opening and closing of the check valve or the difference between P1 and P2 as described above, the rate of inlet flow, and the size of opening in the spray nozzle. Such frequency will range in general to a few per second to one or more milli-seconds per pulse.

DETAILED DESCRIPTION

Figure 1:
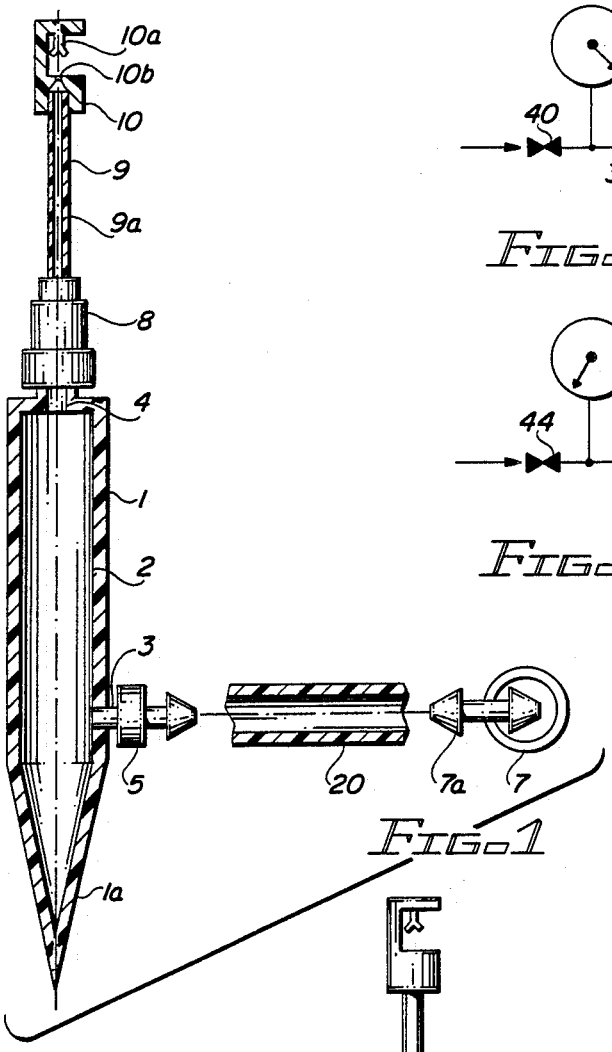
FIG. 1 is a view partly in cross section showing a mini-sprinkler operating with the method described above Its pressure container is made in the form of a spike for inserting in the ground. It operates at a very low flow, wetting a large area. Water is ejected from the spray device at a very high pressure due to a "Water Hammer" created by the quick responses of the check valve. It ejects water and air which is sucked through perforation in the check valve.

FIG. 1 illustrates one preferred form of a mini-sprinkler device operated with the P.H.T. method and formed for direct insertion and support in the soil adjacent to a tree or another area to be irrigated. A pressure container is in the form of a spike 1 having a sharp point 1*a* for ground insertion and enclosing a hollow chamber 2 having a square cross section for retention of water. The shape and dimensions of the container are determined by the particular application and can be of any practical volume. As a spike for insertion in the soil a practical dimension would be as a rectangular cross section 1"×1" with a length of 6"–12". It is formed of a suitable rigid material, preferably of rigid, molded plastic, such that pressure increase within its hollow space will cause it to become slightly rounded and thus increase its volume. The container is provided with an inlet opening 3 and an outlet 4. The inlet opening is fitted with a compensating dripper or other flow control device 5 which is in turn connected to a hose or tube 6 of suitable length for connection by means of a fitting 7*a* to a water supply pipe 7.

Figure 2:
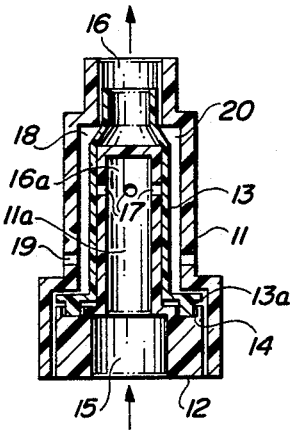
FIG. 2 is a cross section showing one type of a pre-set check valve utilized in the practice of this invention. Such a pre-set check valve has a quick response and it has perforations in its outer casing, which are used for sucking fluid from its surroundings, mixing and ejecting it similar to the operation of a venturi pump.

The outlet is connected to a pre-set check valve 8 of the type illustrated in FIG. 2. This is then connected by means of tube 9 having a small diameter bore 9*a* to a spray means 10 in which water is pulsed through nozzle 10*a* against a deflector 10*b*.

The spray means may be of any suitable type such as a finger spray or a rotary spray or the like where a large diameter spray area is desired.

A preferred type of pre-set check valve 8 which is especially effective in being quickly responsive to fluctuations in pressure and can be used for creating a venturi effect, is illustrated in FIG. 2.

The structure of such pre-set check valve 8 includes three parts: an outer casing 11, an insert 12 and an elastic sleeve 13 made of rubber or the like, which surrounds and fits snugly the outside wall of insert 12. The outer casing and the insert are preferably formed of plastic material. These are concentric and preferably cylindrical. Insert 12, as shown is in the shape of an inverted cuplike member open at the bottom with its side walls surrounded by and engaged by sleeve 13.

Elastic sleeve 13 is formed with a rib 13*a*, which is engaged in a slot 14 made in the insert 12, which is formed with a widened portion at the bottom to accommodate the slot and engage the rib portion of the elastic sleeve also the angular flat portion 13*b* of the elastic sleeve, as shown, serves as a gasket between outer casing 11 and insert 12. The bottom portion of 12 which is not engaged by the sleeve is cemented or force fitted to the bottom portion of casing 11 as shown. Casing 11 and insert 12 are made of rigid material and are cemented together and provide a liquid inlet 15 and outlet 16.

Insert 12 has one or more perforation 17 in its side wall. When liquid pressure inside the insert 12 is at or below a critical pressure P1 the openings will be enclosed by elastic sleeve 13 which surrounds the insert tightly.

When pressure of liquid within the insert 12 is increased above a critical pressure P1, the pressure forces elastic sleeve 13 to expand in an expanding space 18 between casing 11 and insert 12 as shown for example by dotted line 20. Then liquid flows out from insert 12 through perforations 17, and will continue to flow between outside walls of insert 12 and inside walls of elastic sleeve 13 out through outlet 16.

Perforations 19 in the casing 11 connect expanding space 18 with the external surroundings of the pre-set check valve 8 allowing for fluids, namely, external air, to flow into the expanding space 18 and permitting the elastic sleeve to expand into the space.

When liquid flows out from the insert 12 through outlet 16 at a high flow, through a small size diameter tube 9 connected to outlet 16, a high liquid velocity is created at the outlet, creating a vacuum in expanding space 18, which causes fluids surrounding the pre-set check valve 8 to flow from the surroundings through perforations 19 into expanding space 18 and then between the inside of casing 11 and outside of elastic sleeve 13, out through outlet 16, mixing with liquid flowing out from the insert and be ejected, as a mixture, through outlet 16 and tube 9.

When liquid pressure in the insert 12 is reduced below P2, elastic sleeve 13 will return to its position, sealing perforations 17 and preventing liquid within insert 12 from flowing until liquid pressure in the insert 12 is increased again to the critical pressure P1. The pressure P1 which forces elastic sleeve 13 to expand, depends on the wall thickness of the elastic sleeve and the material it is made from. A thicker wall of the elastic sleeve will increase critical pressure P1.

The pressure P2 at which the elastic sleeve will close the outlet from insert 12, depends on the hysteresis of the material the sleeve is made of.

Figure 10A:
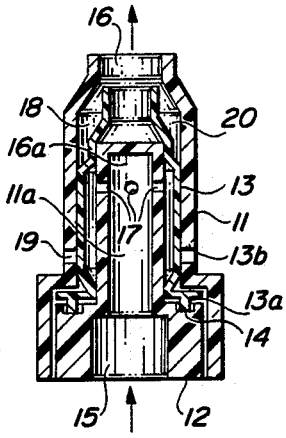
FIGS. 10A and 10B illustrate the function of the device as shown in FIGS. 1, 3 and 4 with the pre-set check valve as illustrated in FIG. 2 showing its pumping action.
Figure 10B:
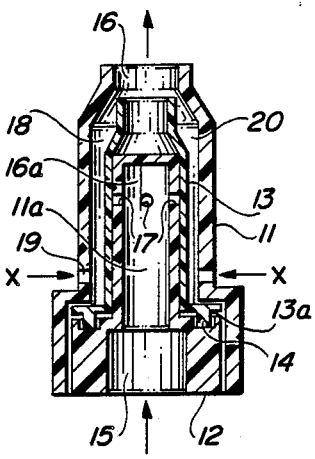

As further illustrated in FIGS. 10A and 10B, the pulsating action described above is shown with arrows X in FIG. 10A showing the direction of flow of the secondary fluid which as in FIG. 2 also enters perforations 19 and fills space 18 confined between elastic sleeve 13 and the outer casing until such time during each pulse that the check valve remains closed. When as described above the pressure reaches the point at which the check valve opens, the sleeve expands to the position shown in FIG. 10B, which is also shown in dotted lines in FIG. 2. This causes the closure of perforations 19 and forces the fluid from space 18 to be forced out between the elastic sleeve and the casing through the outlet 16 to become intermingled with the main fluid. The secondary fluid may be a gas such as air. When the unit is surrounded by a liquid above the perforations this secondary liquid will become admixed with the primary liquid thus functioning as a pump. When the liquid level is below the perforations that flow will cease and only air will enter through perforations 19.

Inlet 15 is designed to snap on the outlet 4 of spike 1 in FIG. 1.

Outlet 16 is designed so that rigid tube 9 in FIG. 1 can be snapped to it.

As shown in FIG. 1, water from the irrigation tube 7 flows through hose 6 and pressure compensated dripper 5 at a low continuously controlled flow Q2 to spike 1 within which it is being accumulated. And its pressure is increased to a critical pre designed pressure P1 at which elastic sleeve 13 of pre-set check valve 8, which is connected to outlet 4 from spike 1, expands, and allows water to flow out from the spike 1 through pre-set check valve 8 to a small sized inside diameter tube 9. Friction loss at tube 9 forces elastic sleeve 13 to widely expand, allowing for a high flow Q1 of water to be ejected from spike 1 through pre-set check valve 8 and tube 9. The high flow ejected from the spike flows through nozzle 10*a* of a spray device 10 and spreads by deflector 10*b* over large designated area.

While water ejects from spike 1 at a high flow Q1, it is supplied into spike 1 through dripper 5 at a low flow Q2, as a result the volume and pressure within spike 1 is decreased to P2 and pre-set check valve 8 closes itself and closes outlet 4 from the spike 1, until more water flows from dripper 5 and is accumulated in spike 1 increasing pressure within the container to P1 and starting a new pulsating cycle.

Due to the quick response of the pre-set check valve 8, a "Water Hammer" is created which increases the pressure and velocity of the ejected water.

Due to the high velocity at tube 9, a venturi effect is created, by which air flows into the pre-set check valve 8 and ejects with the water through spray device 10.

Instead of the elastic sleeve type of check valve described above, a conventional spring loaded check valve may be used in which the spring tension is properly adjusted.

Figure 3:
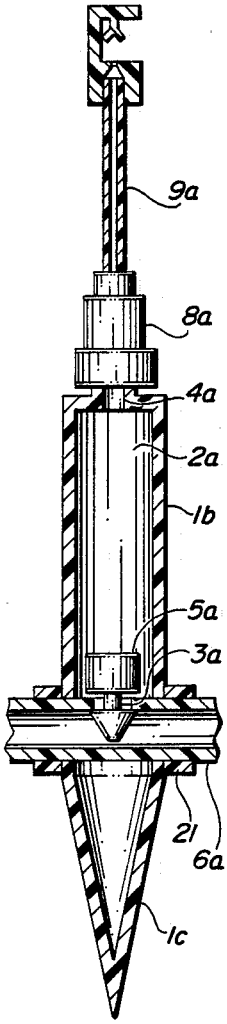
FIG. 3 is a view partly in cross section corresponding to FIG. 1 showing the spike form of container of FIG. 1 divided into two sections mounted upon the liquid conduit.

FIG. 3 describes an alternative manner of installing the device shown in FIG. 1 in which the spike container is divided into two sections 1*b* and 1*c* which are designed to encircle and engage the circumference of water conduit 6*a* which in effect passes through the container and may be engaged at spaced intervals by additional spike units of the same type. During assembly of the sections a compensating dripper 5*a* is inserted into opening 3*a* in the conduit positioned in the upper section as shown, and a controlled flow of water is passed into the chamber 2*a* and passes through outlet 4*a* into check valve 8*a* and tube 9*a* as described above with respect to FIG. 1. The two sections are secured to the conduit by cementing or otherwise and to ensure against leakage a pair of gasket rings 21 may be cemented in place as shown.

Figure 4:
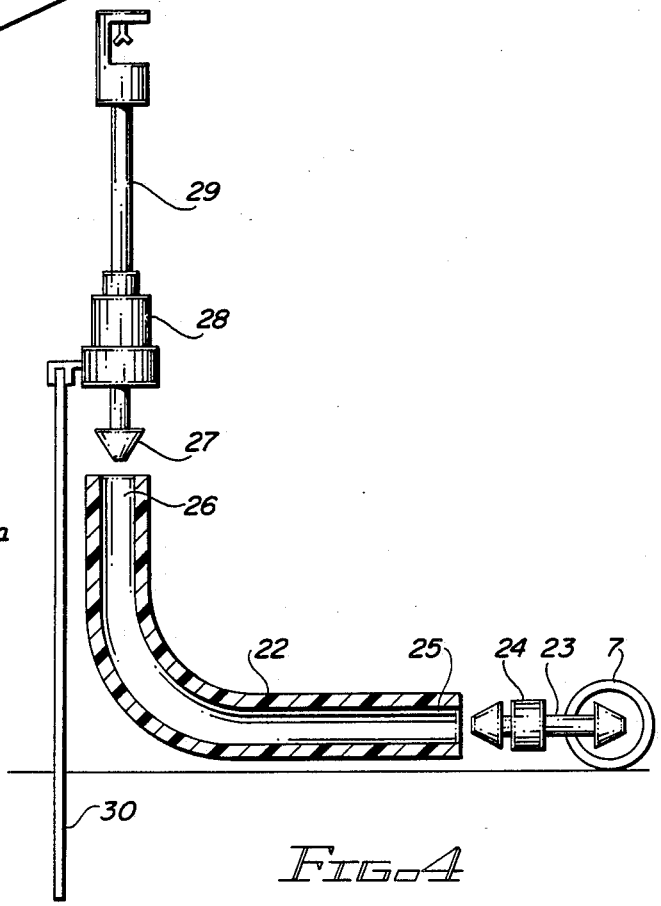
FIG. 4 is a view partly in cross section showing a section of flexible conduit as forming the liquid container upon which the check valve and spray unit are mounted.

As shown in FIG. 4, the container, instead of being in the form of a spike, when utilized to support a sprinkler or similar unit, is in the form of a flexible tube 22 which is connected to water supply 7 by means of a suitable fitting and in turn to a compensating dripper 24 and by means of another fitting to inlet 25 of the tube and the tube is connected at its outlet 26 by means of fitting 27 to check valve 28. The function of the device is similar to that described with respect to FIGS. 1 and 2. Support for the device of FIG. 4 is provided by means of a rod 30 or similar member which is affixed at its upper end to the check valve and may be inserted into the ground as shown to elevate the tubular container.

In practice, the sections would usually be inserted around drippers, whether compensating or non compensating, which are already installed at spaced intervals on line or in line in an irrigating conduit in the field.

Figure 5:
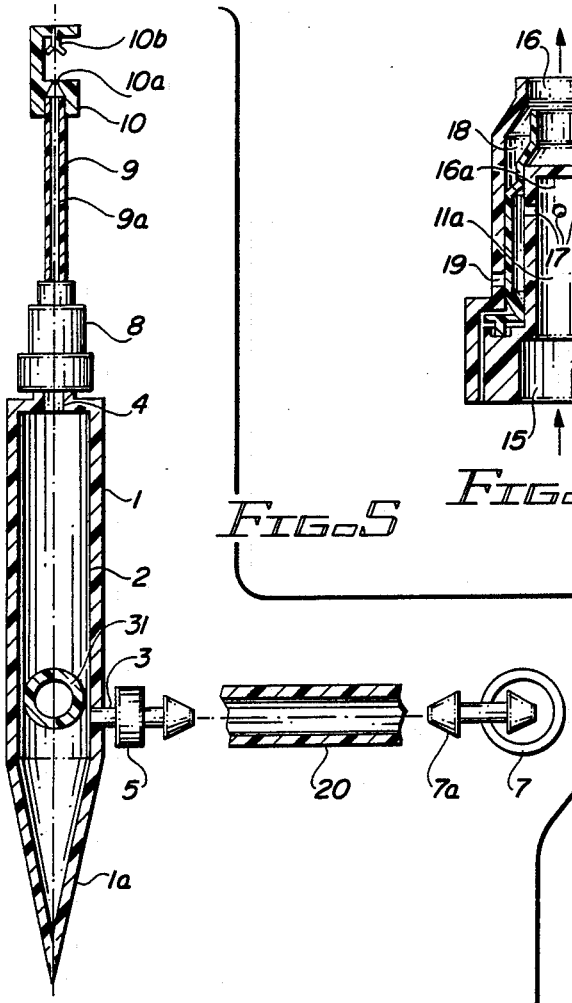
FIG. 5, shows the identical structure of FIG. 1 except that a secondary container containing trapped air is positioned within the receptacle.

As shown in FIG. 5, a small receptacle 31 which is formed of semi-rigid or flexible material containing air is placed within the receptacle to permit trapped air to increase the ejected amount of liquid in each pulse.

Figure 6:
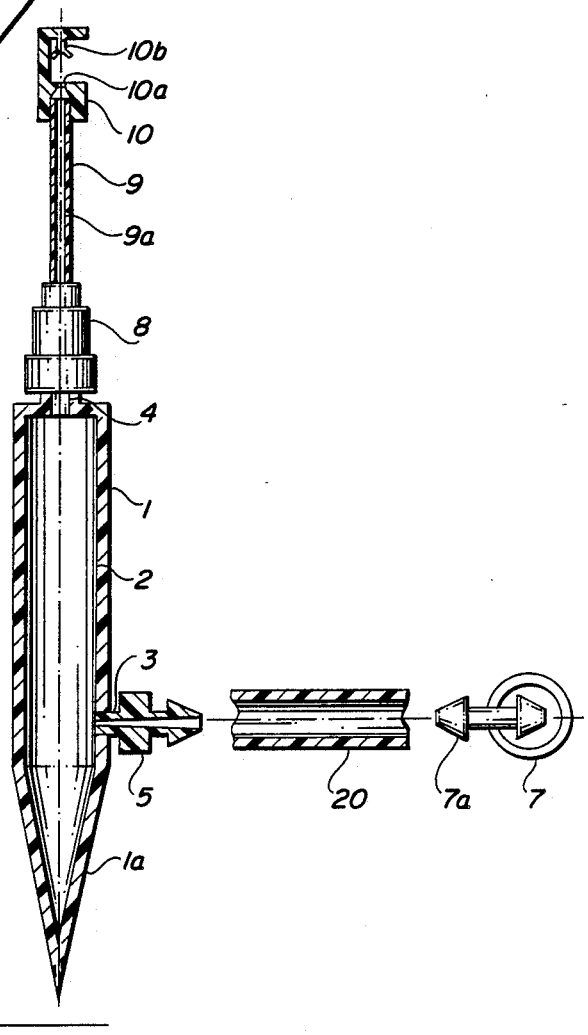
FIG. 6 is identical to FIG. 1 except that a compensating dripper is replaced by a small nozzle.

As shown in FIG. 6, the pressure compensating dripper of FIG. 1 is replaced by a small nozzle 56 which controls flow into the receptacle. The same use of a nozzle can be applied in place of the drippers shown in FIGS. 3 and 4.

Figure 7:
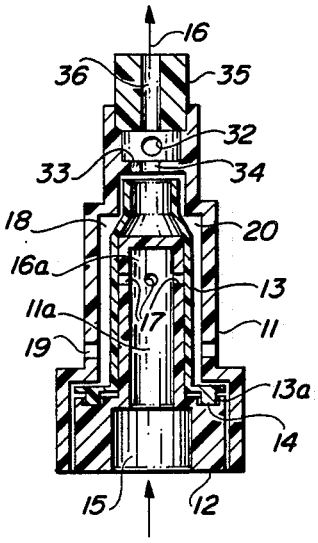
FIG. 7 is identical to FIG. 2 except that provision is made for the insertion of a mechanical obstacle in the outlet of the check valve for example using a movable ball as shown.

In FIG. 7, a mechanical obstacle in the form of a ball which floats which the pressure of liquid flow is incorporated within the outlet structure of the valve in FIG. 2. The ball is placed within a compartment formed by an inner ring 33 provided with an opening 34 and a fitting 35 also provided with an outlet opening 36.

Figure 8:
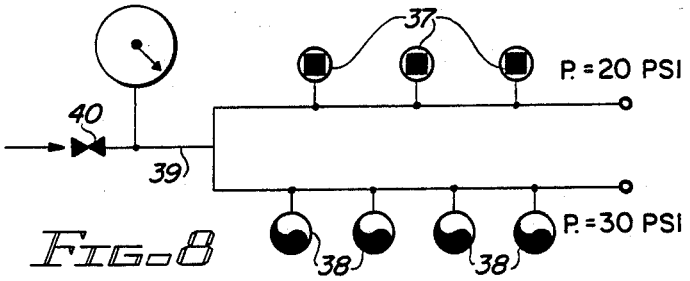
FIG. 8 shows the arrangement of a plurality of sprinklers of the type shown in FIG. 1 with different opening pressures connected to the same irrigation system.

In FIG. 8, the arrangement of a plurality of sprinkler units of the type shown in FIG. 1 in which the check valves are responsive to different pressures. For example, units 37 are pre-set to one pressure, say 20 PSI, which units 38 are pre-set to a higher pressure, say 30 PSI, All of these supplied with liquid through a common feed line 39 with a pressure controller 40 in the circuit. Thus, at a pressure below 20 PSI, none of these will operate since the valves will remain closed. At a pressure of 20 PSI, only sprinklers 37 will operate. At a pressure of 30 PSI, sprinklers 37 and 38 will operate.

Figure 9:
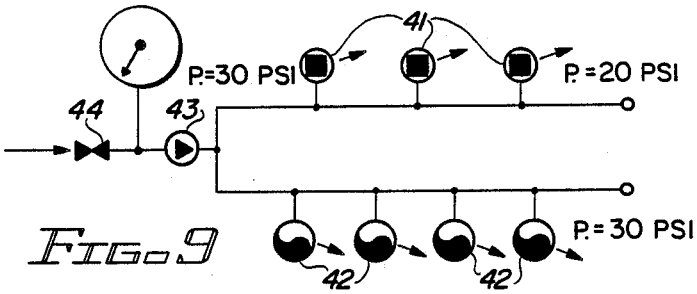
FIG. 9 shows an arrangement in which a plurality of sprinklers such as shown in FIG. 1 which are connected by a common tube to one (or more) drippers.

As shown in FIG. 9, a plurality of sprinkler units of the type shown in FIG. 1, shown as 41 and 42, are connected to a common compensating dripper 43. They may or may not be operative at different pressures. Thus, if the pressure is at 20 PSI and below 30 PSI, only units 41 will operate. At 30 PSI or above, all will operate. Pressure is controlled by controller 44.

I claim:

1. Apparatus for converting pressurized low continuous liquid flow to a high intermittent pulsating flow which comprises a pressure container having a low elasticity, means for supplying a continuous flow of liquid thereto at a controlled low flow rate and thereby establishing a pressurized body of liquid within said container, a pre-set normally closed check valve connected to an outlet from said container, said check valve remaining closed and preventing a liquid from flowing out of the pressure container at a lower pressure and opening at a pre-set higher pressure at which liquid flows out of the container and closes itself at said lower pressure, whereby the outlet from the pressure container will remain closed until liquid flowing into the container causes pressure within the container to increase and the pre-set check valve to re-open thus allowing for a volume of the liquid that was accumulated in the container when pressure was increased, to be ejected through the container outlet and the pre-set check valve, conduit means connected to the outlet of said pre-set valve, means associated with said conduit means providing sufficient resistance to liquid flow to force said pre-set check valve, when it opens, to become widely open, thus allowing for liquid at a high rate of flow to be ejected from said container thereby causing the volume and pressure of the liquid within the container to decrease and said pre-set check valve to close, said pre-set check valve having a quick response as a result of said resistance whereby a "Water Hammer" effect is created thus causing the liquid to be ejected at a higher pressure and velocity than that of the incoming liquid flow.

2. Apparatus according to claim 1, wherein the pre-set check valve consists of an outer casing surrounding and spaced from a hollow insert having perforations in its side wall, an elastic sleeve covering tightly the outside of the insert and its perforations, additional perforations in the outer casing which are exposed to the surroundings of the pre-set check valve, an expansion space between the outer casing and the sleeve, said expansion permitting said elastic sleeve to expand into said expansion space when pressure within the insert is increased, thus allowing liquid to flow from the insert out through its perforations and then between the inside of the sleeve and the outside of the insert and out through the outlet of the check valve.

3. Apparatus according to claim 2 wherein fluid surrounding the outer casing of the check valve is drawn through the perforations therein to become mixed and ejected along with the liquid from the container.

4. Apparatus according to claim 3 wherein the ejection and mixing of fluid surrounding the outer casing of the check valve functions as a fluid injection pump operating at a low flow.

5. A spray device according to claim 3 in which the pressure compensated dripper controls and pressure compensates the ejected flow from the spray device.

6. Apparatus according to claim 1 wherein the means for supplying continuous flow of liquid includes a pressure compensated dripper.

7. Apparatus according to claim 1 in which pressure container is formed of a rigid material with low flexibility such that pressure increase within the container will cause some deformation and thereby increase its volume while under pressure.

8. An apparatus according to claim 1, in which container is made of rigid material and includes trapped air in a secondary container there within.

9. An apparatus according to claim 1 in which the pressure container is made of non-plastic material.

10. An apparatus according to claim 1, in which liquid flow to the pressure container is controlled by a non-compensated dripper.

11. An apparatus according to claim 1 in which liquid flow to the device is controlled by a small nozzle.

12. An apparatus according to claim 1 in which outlet of liquid flow controlling mean is connected to inlet of pressure container.

13. An apparatus according to claim 1 in which liquid flow is controlled by a means incorporated within the pressure container.

14. An apparatus according to claim 1 in which resistance to the flow is created by a small inside diameter tube connected to the outlet of the pre-set check valve, which tube is so dimensioned as to permit said "Water Hammer" effect to occur.

15. An apparatus according to claim 1 in which resistance to the flow is created by a long tube, connected to the outlet of the pre-set check valve, said tube having a length sufficient to permit said "Water Hammer" effect to occur.

16. An apparatus according to claim 1 wherein resistance to liquid flow from the outlet of the check valve is created by a small orifice connected to said outlet in the path of liquid flow therefrom, said orifice being sufficiently restricted to permit said "Water Hammer" effect to occur.

17. Apparatus according to claim 1 wherein resistance to flow from the pressure container outlet is imparted by an elevated spray nozzle connected to said outlet by an elongated tube the length of which is sufficient to impart sufficient resistance to flow to permit said "Water Hammer" effect to occur.

18. Apparatus according to claim 1 wherein resistance to flow of liquid from the pressure container outlet and the pre-set check valve is created by means of a mechanical obstacle positioned in the path of said flow, said obstacle restricting said flow sufficiently to permit said "Water Hammer" effect to occur.

19. Apparatus according to claim 1 in which a liquid at a low flow rate is sprayed over a designated area by means of a spray nozzle connected to the outlet of the check valve.

20. Apparatus according to claim 1 wherein the pressure container is in the form of a section of flexible tubing connected to a liquid supply means at its inlet and to said check valve at its outlet.

21. Apparatus according to claim 20 wherein said flexible tubing is supported in an elevated position by means of a vertical rod connected at its upper end to said check valve.

22. A sprinkler in which a pressurized low continuous liquid flow if converted to a high intermittent pulsating flow which comprises a pressure container having low elasticity in the form of a spike, means for supplying a continuous flow of liquid thereto at a controlled low flow-rate by means of a pressure compensated dripper and thereby establishing a pressurized body of liquid within said container, a pre-set normally closed check valve connected to an outlet from said pressure container said check valve having an elastic sleeve within a perforated casing, said check valve remaining closed and preventing liquid from flowing out of said pressure container at a lower pressure and opening at a pre-set higher pressure whereby the outlet from said pressure container will remain closed until liquid flowing into the container causes pressure therein to increase and the pre-set check valve to open this allowing for a volume of the liquid that accumulated in the container while pressure was being increased to be ejected through the container outlet and check valve, and a spray device connected to the outlet of said check valve by means of a small inside diameter tube, thereby providing a sprinkler in which liquid is ejected at a high pressure created by "Water Hammer" resulting from a quick response of the pre-set check valve while permitting air to be drawn through said perforations to become mixed and ejected with the liquid.

23. A plurality of sprinklers according to claim 22 in which each has a pre-set check valve with a different opening pressure connected to the same irrigation system and controlled by changing pressures in the irrigation system.

24. A plurality of sprinklers according to claim 22 connected by a common tube to one or more common drippers.

25. A sprinkler according to claim 22 wherein the spike is divided into upper and lower sections which encompass and communicate with a liquid conduit which passes between said sections together with the dripper positioned therewithin.

26. A sprinkler according to claim 25 wherein a plurality of said spike units are positioned at spaced intervals along said conduit.

27. A method for converting pressurized low continuous liquid flow to a high intermittent pulsating flow which comprises supplying liquid at a constant continuous relatively controlled rate to a closed chamber having low elasticity having inlet and outlet means and establishing a body of liquid under pressure therein, preventing outflow of liquid through said outlet means until a designated pre-determined pressure is achieved, then allowing said liquid to flow out from said chamber through said outlet means until the pressure is diminished to a pre-determined level while at the same time restricting said outflow sufficiently to create a "Water Hammer" effect to generate a high pressure liquid pulse and at that point quickly discontinuing emission of liquid until pressure within said chamber is again increased to said pre-determined level and repeating said sequence repeatedly for a desired period of time to achieve said intermittent pulsating effect.

28. A method according to claim 27 wherein the liquid is water wherein said water is discharged adjacent to growing plants for irrigation purposes.

29. A method according to claim 28 wherein the outflow said water is quickly interrupted during each cycle to cause pressurized ejection thereof by means of said "Water Hammer" effect created thereby, in the form of a spray.

* * * * *